US009764457B2

(12) United States Patent
Lundgren

(10) Patent No.: US 9,764,457 B2
(45) Date of Patent: Sep. 19, 2017

(54) PERCUSSION DEVICE COMPRISING A DAMPING MECHANISM

(71) Applicant: CONSTRUCTION TOOLS PC AB, Kalmar (SE)

(72) Inventor: Anders Lundgren, Degerhamn (SE)

(73) Assignee: CONSTRUCTION TOOLS PC AB, Kalmar (SE)

( * ) Notice: Subject to any disclaimer, the term of this patent is extended or adjusted under 35 U.S.C. 154(b) by 491 days.

(21) Appl. No.: 14/378,843

(22) PCT Filed: Feb. 11, 2013

(86) PCT No.: PCT/SE2013/050113

§ 371 (c)(1),
(2) Date: Aug. 14, 2014

(87) PCT Pub. No.: WO2013/122535

PCT Pub. Date: Aug. 22, 2013

(65) Prior Publication Data

US 2015/0034351 A1 Feb. 5, 2015

(30) Foreign Application Priority Data

Feb. 17, 2012 (SE) ..... 1250137

(51) Int. Cl.
*B25D 17/24* (2006.01)

(52) U.S. Cl.
CPC ..... *B25D 17/24* (2013.01); *B25D 2222/57* (2013.01); *B25D 2222/69* (2013.01); *B25D 2250/085* (2013.01)

(58) Field of Classification Search
CPC B25D 17/24; B25D 17/06; B25D 2217/0092; B25D 11/125;
(Continued)

(56) References Cited

U.S. PATENT DOCUMENTS 5,117,923 A * 6/1992 Wuhrer ..... B25D 9/12 173/109
5,996,708 A 12/1999 Gerold

FOREIGN PATENT DOCUMENTS

EP 162960 A2 2/2006
EP 2314420 A1 4/2011
(Continued)

OTHER PUBLICATIONS

PCT/ISA/210—International Search Report—Jun. 3, 2013 (Issued in PCT/SE2013/050113).
(Continued)

*Primary Examiner* — Michelle Lopez
(74) *Attorney, Agent, or Firm* — Venable LLP; Jeffri A. Kaminski

(57) ABSTRACT

A percussion device including a shank adaptor, a machine housing that contains a percussion piston that is arranged to carry out a reciprocating movement caused by the pressure from a hydraulic fluid and to strike the shank adaptor when the percussion device is in use. An elastic element is arranged radially outwards from the percussion piston to dampen the recoil from the shank adaptor. The machine housing has an inner surface that faces the percussion piston. The elastic element has an inner surface that faces the percussion piston and an outer surface that faces the inner surface of the machine housing. At least a part of the outer surface of the elastic element directly faces the inner surface of the machine housing.

10 Claims, 1 Drawing Sheet

Figure 1:
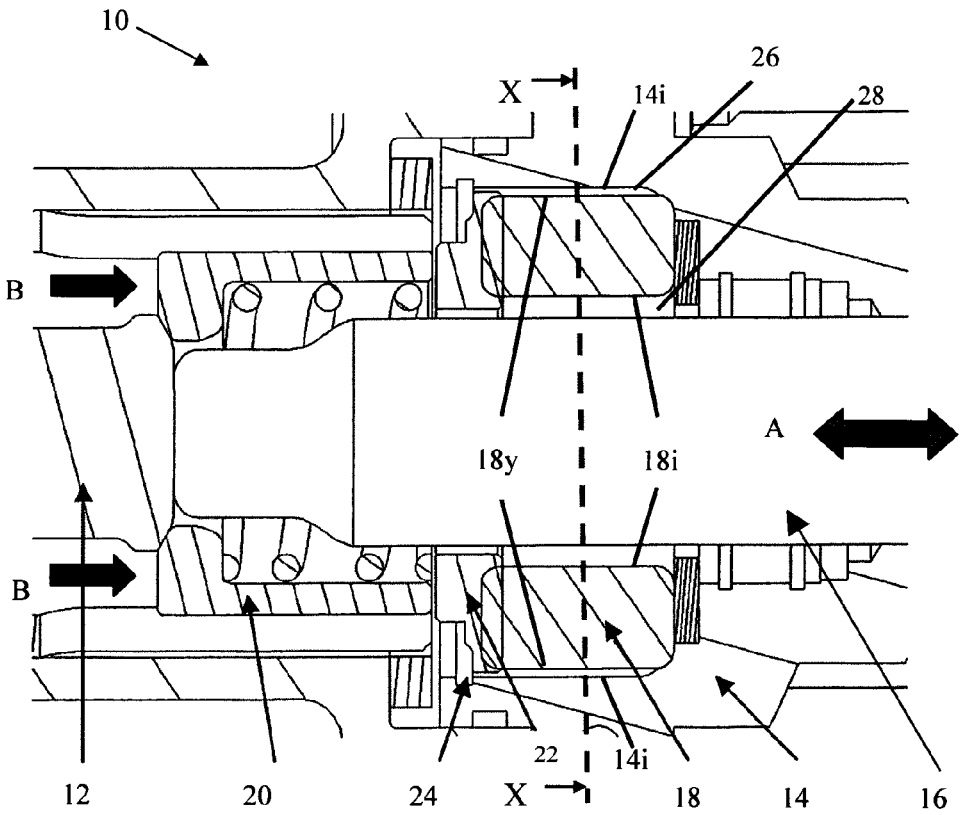

(58) Field of Classification Search
CPC ..... B25D 2250/371; B25D 11/005; B25D 2222/69; B25D 2250/085
USPC ..... 173/210, 200
See application file for complete search history.

(56) References Cited

FOREIGN PATENT DOCUMENTS

| | | | |
|---|---|---|---|
| GB | 281479 | A | 10/1959 |
| WO | WO-2008069685 | A1 | 6/2008 |

OTHER PUBLICATIONS

PCT/ISA/237—Written Opinion of the International Searching Authority—Jun. 3, 2013 (Issued in PCT/SE2013/050113).

* cited by examiner

PERCUSSION DEVICE COMPRISING A DAMPING MECHANISM

CROSS-REFERENCE TO RELATED APPLICATIONS

This application claims priority to Swedish patent application 1250137-5 filed 17 Feb. 2012and is the national phase under 35 U.S.C. §371 of PCT/SE2013/050113 filed 11 Feb. 2013.

The present invention concerns a percussion device, for example a handheld and/or hand-maneuvered percussion device, such as a chisel, hammer or drilling machine.

BACKGROUND OF THE INVENTION

Percussion devices, such as handheld or hand-maneuvered drilling machines, often contain a recoil damper to absorb the cyclic recoil from the drill string/shank adaptor and to prevent it from continuing to be displaced inside the machine housing that contains the percussion device's percussion mechanism. This results in lower vibration levels and less noise, which results in an improved and healthier work environment for operators, and less disruption for people in the surrounding area. This also means that it is simpler for operators to handle the percussion device. The continuous mechanical forces that arise during the use of the percussion device can namely require significant strength of an operator to handle the percussion device.

U.S. Pat. No. 5,996,708 discloses a percussion device that comprises an axially displaceable shank adaptor that is arranged to hold a tool and a percussion piston that is arranged to carry out a reciprocating movement caused by the pressure from a hydraulic fluid and to strike the shank adaptor when the percussion device is in use. The percussion device comprises a recoil damper to dampen the recoil from the shank adaptor. The recoil damper consists of a hollow transmission element that contains an elastic ring and a stop ring. The elastic ring and stop ring are clamped in the transmission element of a locking element. The shank adaptor is arranged to strike a bevel on the stop ring during its recoil. In order to assemble the recoil damper the stop ring and the elastic ring must be placed in the hollow transmission element and be fixedly locked using the locking element. The recoil damper can thereafter be mounted inside the percussion device as a unit.

SUMMARY OF THE INVENTION

An object of the present invention is to provide an improved percussion device.

This object is achieved by a percussion device that comprises a shank adaptor and a machine housing that contains a percussion piston that is arranged to carry out a reciprocating movement caused by the pressure from a hydraulic fluid, i.e. a hydraulic fluid or -gas, and strike the shank adaptor when the percussion device is in use. The percussion device also comprises an elastic element that is arranged radially outwards from the percussion piston to dampen the recoil from the shank adaptor. The machine housing has an inner surface that faces the percussion piston and an outer surface that faces the surroundings. The elastic element has an inner surface that faces the percussion piston and an outer second surface that faces the inner surface of the machine housing.

At least a part of the elastic element's outer surface directly faces the machine housing's inner surface, i.e. there is no component between the elastic element's outer surface and the machine housing's inner surface in the at least one part of the elastic element's outer surface that directly faces the machine housing's inner surface. The elastic element is namely placed directly inside the machine housing, and is not placed in some other component/sleeve that is thereafter placed inside the machine housing.

Such a percussion device therefore contains a simple recoil damper that absorbs the cyclic recoil from the shank adaptor and prevents it from being displaced further in the percussion device's machine housing. This means that lower vibration levels and less noise are obtained, which results in an improved and healthier working environment for operators, and less disruption for people in the surrounding area. This also means that it is simpler for operators to handle the percussion device.

According to an embodiment of the invention the inner surface of the elastic element directly faces the percussion piston when the percussion device is in use, i.e. there is no component between the elastic element's inner surface and the percussion piston, but only gas/air therebetween. Such a solution means that the elastic element can expand into part of the gap between its inner surface and the percussion piston if/when it is heated up during use or on compression. If an elastic element is prevented from expanding when a percussion device is in use, this can lead to stress/strain in the elastic element, which stress/strain can damage the elastic element and consequently shorten its lifetime.

According to an embodiment of the invention the percussion device comprises a transmission element, such as a spring loaded transmission element, whereby the shank adaptor is arranged to strike the transmission element during its recoil.

According to an embodiment of the invention the elastic element is arranged symmetrically around the percussion piston. According to another embodiment at least a part of the elastic element's outer surface is in contact with the machine housing's inner surface.

It should be noted that the expression "elastic element" in this document means one or more individual elastic components. An elastic element can for example be made up of a single ring of elastic material, or of a plurality of connected or individual blocks of elastic material.

According to an embodiment of the invention the percussion device comprises a stop plate, such as a stop ring/stop disc, that is arranged between the transmission element and the elastic element. Alternatively, according to another embodiment of the invention, the elastic element is compressed using a screw joint reinforcement.

According to another embodiment of the invention the elastic element comprises a ring-shaped element.

According to a further embodiment of the invention the percussion device comprises a locking element to fasten or tighten the elastic element in the machine housing. According to an embodiment of the invention the percussion device comprises a locking element to fasten or tighten the stop plate in the machine housing. According to an embodiment of the invention the same locking element is arranged to fasten of tighten both the elastic element and the stop plate in the machine housing.

According to another embodiment of the invention the percussion device comprises a gap between the outer surface of the elastic element and the inner surface of the machine housing when the elastic element is at room temperature, i.e. before the percussion device is used or after the percussion device has been used and cooled down. The elastic element is arranged to expand into at least a part of this gap if/when it is heated up during use or on compression.

According to a further embodiment of the invention the percussion device comprises a gap between the inner surface of the elastic element and the percussion piston when the percussion device is in use. The elastic element can be arranged to expand into a part of this gap if/when it is heated up during use.

According to an embodiment of the invention the percussion piston is arranged to strike the shank adaptor at a frequency of 10 Hz or 50 Hz or higher, preferably at least 60 Hz, more preferably at least 70 Hz, most preferably at least 80 Hz or higher.

According to another embodiment of the invention the elastic element comprises at least one of the following materials: rubber, such as nitrile rubber, neoprene rubber or fluoro-rubber, and/or polyurethane. If the elastic element is subjected to hydraulic fluid or lubricant when the percussion device is in use, it can at least partly be manufactured from a material, such as polyurethane, that will protect it from such. Alternatively, an elastic element that for example comprises rubber that is sensitive to hydraulic fluid or lubricant can be arranged with an at least partly covering protective layer, such as at polyurethane layer.

According to a further embodiment of the invention the percussion device is a handheld or hand-maneuvered percussion device, such as a handheld and/or hand-maneuvered hydraulic fluid-driven chisel, hammer or drilling machine.

BRIEF DESCIPTION OF THE DRAWINGS

Figure 2:
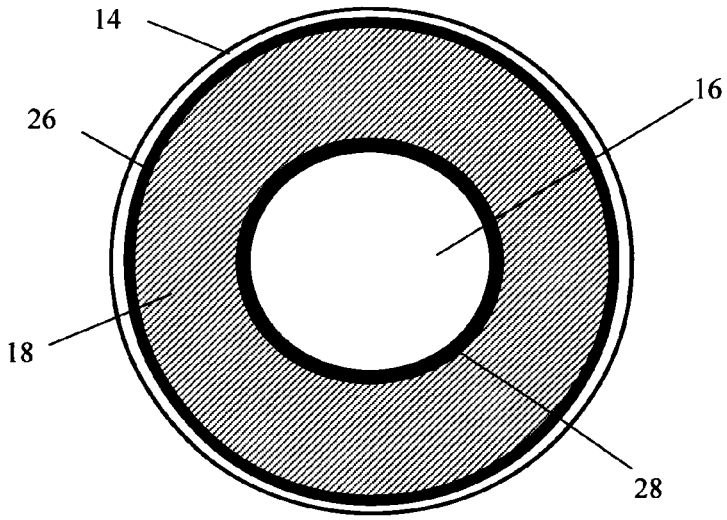

In the following, the present invention shall be described in more detail with reference to the accompanying schematic figures, in which:

FIG. 1 shows a part of a percussion device according to an embodiment of the present invention, and FIG. 2 shows a cross section along line X-X in FIG. 1.

It should be noted that the drawings have not necessarily been drawn to scale and that the dimensions of certain features may have been exaggerated for the sake of clarity.

DETAILED DESCRIPTION OF THE EMBODIMENTS

FIG. 1 shows part of a hydraulic fluid-driven percussion device 10 according to an embodiment of the present invention. The percussion device 10 comprises a shank adaptor 12 and a substantially cylindrical machine housing 14 that contains a percussion piston 16. The percussion piston 16 is arranged to carry out a reciprocating movement (indicated by arrow A), for example at a frequency of 10 Hz or higher, along its longitudinal axis, and to strike the shank adaptor 12 when the percussion device 10 is in use.

An elastic element 18, such as a rubber ring, is arranged radially outwards from the percussion piston 16 to dampen the recoil from the shank adaptor 12. The shank adaptor 12 is arranged to strike a transmission element 20 during its recoil (which recoil movement is indicated by the arrows B). The transmission element 20 is spring loaded and arranged to follow the shank adaptor's 12 movements during it recoil. For example, the transmission element 20 is arranged to be displaced 5-10 mm forwards and backwards along the percussion device's longitudinal axis with the shank adaptor 12.

The machine housing 14 has an inner surface 14*i* that faces the percussion piston 16. The elastic element 18 has an inner surface 18*i* that faces the percussion piston 16 and an outer surface 18*y* that faces the inner surface 14 in the machine housing 14. In the illustrated embodiment the elastic element's 18 entire outer surface 18*y* directly faces the machine housing's 14 inner surface 18*i* with only gas/air therebetween. Only 25%, 50% or 75% of the elastic element's 18 outer surface 18*y* can however be arranged to directly face the machine housing's 14 inner surface 18*i*.

The percussion device 10 comprises a stop plate 22 arranged between the transmission element 20 and the elastic element 18, and a locking element 24 to fasten or tighten the stop plate 22 and the elastic element 18 in the machine housing 14.

In the illustrated embodiment there is a gap 26 between the outer surface 18*y* of the elastic element 18 and the inner surface 14*i* of the machine housing 14 when the elastic element 18 is at room temperature. The elastic element 18 can expand into at least part of this gap 26 if/when it is heated up during use or on compression.

The illustrated percussion device 10 also comprises a gap 28 between the inner surface 18*i* of the elastic element 18 and the percussion piston 16 when the percussion device 10 is in use. The elastic element 18 can also expand into part of this gap 28 if/when it is heated up during use or on compression.

According to an embodiment of the invention the elastic element 18 is pre-tensioned, for example a few millimeters, in order to have an increased initial force towards the left in FIG. 1 so that the percussion point will not vary too much when the percussion device 10 is in use. The pre-tensioning can be achieved by arranging the elastic element to be slightly too long so that it is compressed when the two different machine housings are brought together when the percussion device 10 is in use.

FIG. 2 shows a cross section along line X-X in FIG. 1 and shows the gap 26 between the outer surface 18*y* of the elastic element 18 and the inner surface 14*i* of the machine housing 14, and the gap 28 between the inner surface 18*i* of the elastic element 18 and the percussion piston 16.

Several modifications of the inventions would be possible within the scope of the accompanying claims. For example, even though the illustrated embodiments are directed to a ring-shaped elastic element 18, a ring-shaped stop plate 22, a cylindrical percussion piston 16 and a substantially cylindrical machine housing 14, a percussion device 10 according to the present invention and its components may be of any suitable shape.

The invention claimed is:

1. A percussion device, comprising:

a shank adaptor, a percussion piston that is arranged to carry out a reciprocating movement caused by pressure from a hydraulic fluid and to strike said shank adaptor when the percussion device is in use, a machine housing containing said percussion piston, an elastic element that is arranged radially outwards from said percussion piston to dampen a recoil from said shank adaptor, wherein said machine housing has an inner surface that faces said percussion piston, and wherein said elastic element has an inner surface that faces said percussion piston and an outer surface that faces said inner surface of said machine housing, whereby at least a part of said outer surface of said elastic element directly faces said inner surface of said machine housing, and whereby the inner surface of the elastic element directly faces the percussion piston when the percussion device is in use; and a gap defined between the outer surface of said elastic element and said inner surface of said machine housing when said elastic element is at room temperature.

2. The percussion device according to claim 1, further comprising:

a transmission element, whereby said shank adaptor is arranged to strike said transmission element during recoil of the shank adapter.

3. The percussion device according to claim 1, further comprising:

a stop plate that is arranged between said transmission element and said elastic element.

4. The percussion device according to claim 3, further comprising:

a locking element to fasten or tighten said stop plate in said machine housing.

5. The percussion device according to claim 1, wherein said elastic element comprises a ring-shaped element.

6. The percussion device according to claim 1, further comprising:

a locking element to fasten or tighten said elastic element in said machine housing.

7. The percussion device according to claim 1, further comprising:

a gap between the inner surface of said elastic element and said percussion piston when percussion device is in use.

8. The percussion device according to claim 1, wherein said percussion piston is arranged to strike said shank adaptor at a frequency of 10 Hz or higher.

9. The percussion device according to claim 1, wherein said elastic element comprises at least one of the following materials: rubber, polyurethane.

10. The percussion device according to claim 1, wherein the percussion device is a handheld and/or hand-maneuvered percussion device.

* * * * *